US008713739B1

(12) United States Patent
Alas et al.

(10) Patent No.: US 8,713,739 B1
(45) Date of Patent: May 6, 2014

(54) BATTERY OPERATED DETACHABLE BACK SCRUBBER

(71) Applicants: Jorge Alas, Las Vegas, NV (US); Kim Alas, Las Vegas, NV (US)

(72) Inventors: Jorge Alas, Las Vegas, NV (US); Kim Alas, Las Vegas, NV (US)

( * ) Notice: Subject to any disclaimer, the term of this patent is extended or adjusted under 35 U.S.C. 154(b) by 0 days.

(21) Appl. No.: 13/780,915

(22) Filed: Feb. 28, 2013

(51) Int. Cl.
*A46B 13/04* (2006.01)
*A46B 11/02* (2006.01)
*A46B 11/06* (2006.01)

(52) U.S. Cl.
USPC ..... 15/29; 15/28; 401/284; 401/286; 401/288; 601/17; 601/112; 601/114

(58) Field of Classification Search
None
See application file for complete search history.

(56) References Cited

U.S. PATENT DOCUMENTS

| | | | | |
|---|---|---|---|---|
| 3,277,509 | A | 10/1966 | McNair et al. | |
| 5,647,841 | A | 7/1997 | Groenewold et al. | |
| 6,170,108 | B1 | 1/2001 | Knight | |
| 7,309,180 | B2 | 12/2007 | Russell et al. | |
| 7,963,253 | B1 * | 6/2011 | Bauknecht | 119/608 |

* cited by examiner

*Primary Examiner* — Monica Carter
*Assistant Examiner* — Stephanie Berry
(74) *Attorney, Agent, or Firm* — Crossley Patent Law; Micah C. Gunn

(57) ABSTRACT

A battery operated detachable back scrubber that includes a head portion releasably attachable at a distal end of a handle, said head portion having a motor interiorly disposed, which motor operationally engages a rotatable connect socket centrally disposed in a first side of the head portion, said rotatable connect socket operationally communicating the kinetic energy from the motor to a drive shaft of an interchangeable attachment member releasably attachable to the head portion, wherein a plurality of tactile devices disposed on a front surface of a base of the attachment member are mechanically manipulable for use in scrubbing or massaging, as desired.

8 Claims, 4 Drawing Sheets

BATTERY OPERATED DETACHABLE BACK SCRUBBER

BACKGROUND OF THE INVENTION

Various types of battery operated back scrubbers are known in the prior art. However, what is needed is a battery operated detachable back scrubber that includes a head portion releasably attachable at a distal end of a handle, said head portion having a motor interiorly disposed, which motor operationally engages a rotatable connect socket centrally disposed in a first side of the head portion, said rotatable connect socket operationally communicating the kinetic energy from the motor to a drive shaft of an interchangeable attachment member releasably attachable to the head portion, wherein a plurality of tactile devices disposed on a front surface of a base of the attachment member are mechanically manipulable for use in scrubbing or massaging, as desired.

FIELD OF THE INVENTION

The present invention relates to a battery operated detachable back scrubber, and more particularly, to a battery operated detachable back scrubber for example that includes a head portion releasably attachable at a distal end of a handle, said head portion having a motor interiorly disposed, which motor operationally engages a rotatable connect socket centrally disposed in a first side of the head portion, said rotatable connect socket operationally communicating the kinetic energy from the motor to a drive shaft of an interchangeable attachment member releasably attachable to the head portion, wherein a plurality of tactile devices disposed on a front surface of a base of the attachment member are mechanically manipulable for use in scrubbing or massaging, as desired.

SUMMARY OF THE INVENTION

The general purpose of the battery operated detachable back scrubber, described subsequently in greater detail, is to provide a battery operated detachable back scrubber which has many novel features that result in a battery operated detachable back scrubber which is not anticipated, rendered obvious, suggested, or even implied by prior art, either alone or in combination thereof.

Many devices for scrubbing the dorsal side of a human are seen in the prior art. However, what is needed is a battery operated detachable back scrubber that includes a head portion releasably attachable at a distal end of a handle, said head portion having a motor interiorly disposed, which motor operationally engages a rotatable connect socket centrally disposed in a first side of the head portion, said rotatable connect socket operationally communicating the kinetic energy from the motor to a drive shaft of an interchangeable attachment member releasably attachable to the head portion, wherein a plurality of tactile devices disposed on a front surface of a base of the attachment member are mechanically manipulable for use in scrubbing or massaging, as desired.

The present device considers a plurality of interchangeable attachment members, each of which attachment members is releasably connectable to the head portion. Each of the plurality of interchangeable attachment members includes a different arrangement of tactile devices. The tactile devices are considered to include bristles and massage pads, operationally engaged by means of the motor, whereby a plurality of bristles on a particular attachment member is caused to rotate, for example, when said attachment member is connected to the head portion. Alternately, another of the plurality of attachment members may include an arrangement of massage pads in lieu of the plurality of bristles, each of said massage pads operationally engaged by means of the motor to transfer kinetic energy from the motor to the body of a user, as desired. Embodiments of the plurality of attachment members include long bristles for scrubbing, short bristles for exfoliating, massage pads configured for deep tissue massage and light massage, and bristles and massage pads of different substances and materials.

The present device, therefore, includes a head portion releasably attachable to a handle. The handle includes a rubber grip section disposed proximal a proximal end and a pair of spring hooks disposed at a distal end. Each of said pair of spring hooks is configured to releasably connect with an interconnect disposed upon a circumferential surface of the head portion. Thusly, the head portion is releasably attachable to the handle and may be wielded attached to the handle, as desired, to scrub and alternately massage hard-to-reach places on the dorsal side of a user. The head portion may also be detached from the handle and used in a single hand to massage or scrub another person or for use by a user, as desired.

The head portion includes a first side and a second side disposed in parallel. In the preferred embodiment herein disclosed, the head portion is circular. The circumferential surface is therefore disposed perimetrically around the head portion in between each of the first side and the second side. It should be readily understood that this circumferential surface is also considerable as a bordering surface, and should be so considered should the head portion be rendered in any form other than a circular form.

A battery compartment is disposed within the head portion, said battery compartment accessible through the second side. The battery compartment is wired in circuit with the motor. It should be readily understood that the battery compartment is a sealable enclosure whereby batteries stored therein to power the device are prevented from contact with water with which the device may be used.

To activate and deactivate the device a power button is disposed on the second side of the head portion. The power button is depressible and alternately connects the circuit between the battery compartment and the motor and disconnects said circuit when depressed.

The motor includes a gear wheel which operationally communicates with a drive belt. The drive belt is in operational communication with the rotatable connect socket disposed in the first side of the head portion. The gear wheel and the drive belt are considered to increase the torque of the motor, whereby a motor of a lesser size and weight is usable within the head portion than would otherwise be required to exert the same rotational force upon the rotatable connect socket.

The rotatable connect socket is centrally disposed in the first side of the head portion. The rotatable connect socket is configured to releasably engage with a drive shaft disposed rearwardly from a rear surface of the base of each of the plurality of attachment members. The particular attachment member desired for use is simply interconnected with the rotatable connect socket, the drive shaft releasably inserts thereto, and kinetic energy is transferred from the motor to the tactile devices operative upon the front surface of the attachment member when the power button is depressed.

While the handle enables use of the device by a single person to reach those hard-to-reach places on the dorsal side of the human body, the head portion is detachable from the handle whereby the head portion is usable in a single hand to scrub and alternately massage the body of the user, or, when desired, the body of a another person being washed or massaged by the user. To securably retain the head portion in a single hand during use, a hand strap is included. The hand strap is disposed on the second side of the head portion and is configured to gird the back of a user's hand when holding the head portion in the palm of said hand.

Thus has been broadly outlined the more important features of the present battery operated detachable back scrubber so that the detailed description thereof that follows may be better understood and in order that the present contribution to the art may be better appreciated.

Objects of the present battery operated detachable back scrubber, along with various novel features that characterize the invention are particularly pointed out in the claims forming a part of this disclosure. For better understanding of the battery operated detachable back scrubber, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
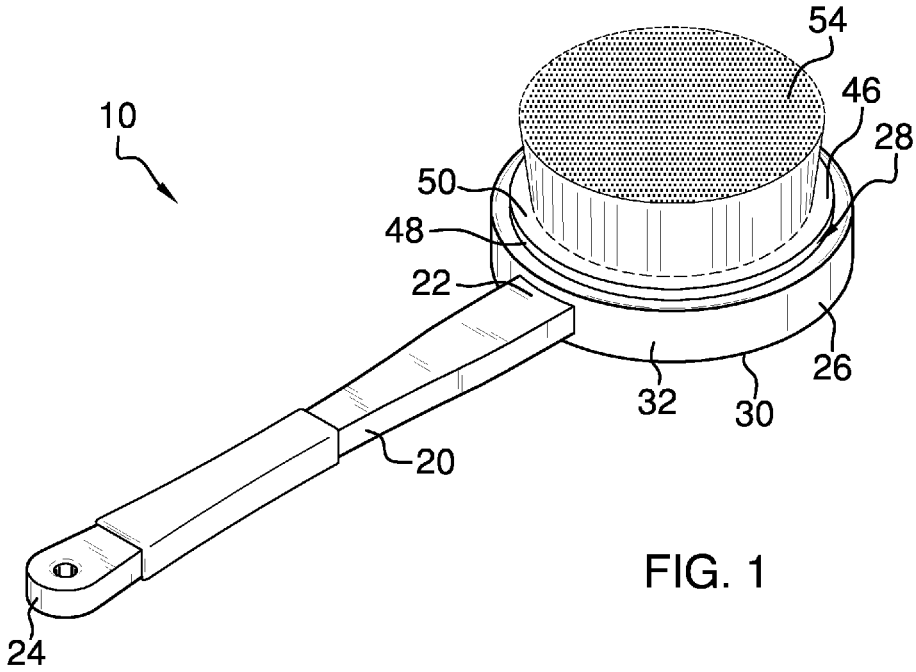
FIG. 1 is an isometric view.
Figure 2:
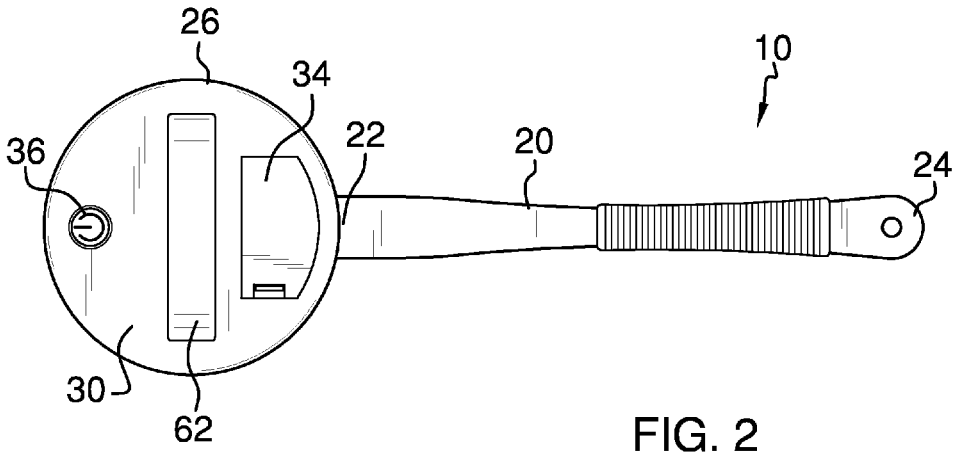
FIG. 2 is a top view.
Figure 3:
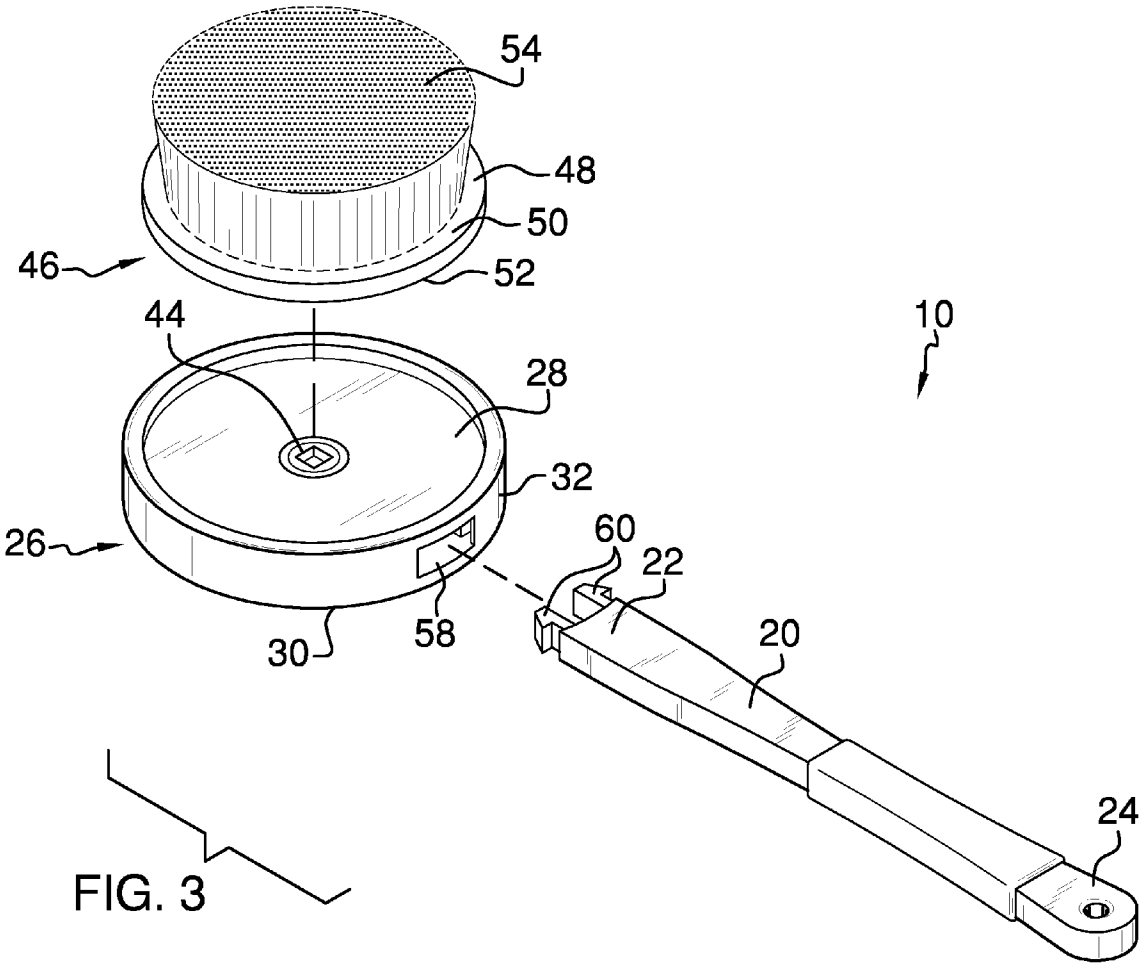
FIG. 3 is an exploded view.
Figure 4:
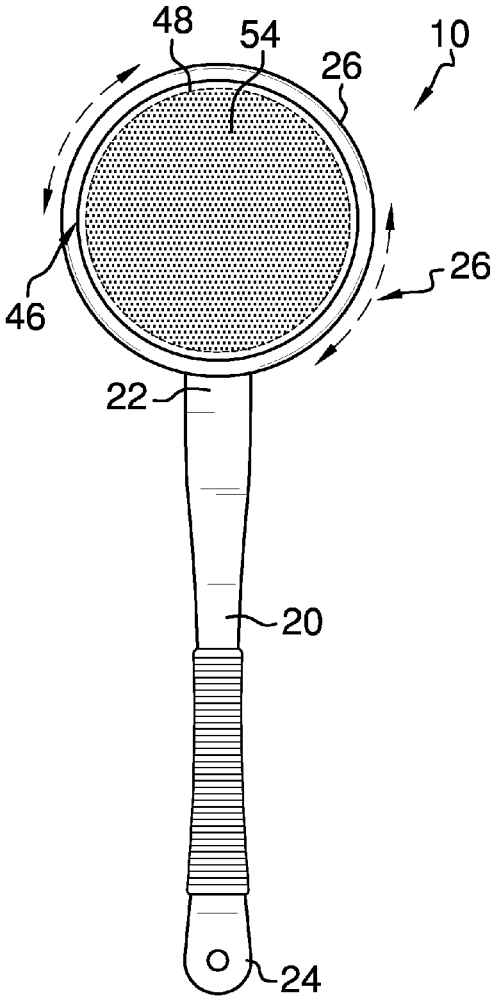
FIG. 4 is a bottom view.
Figure 5:
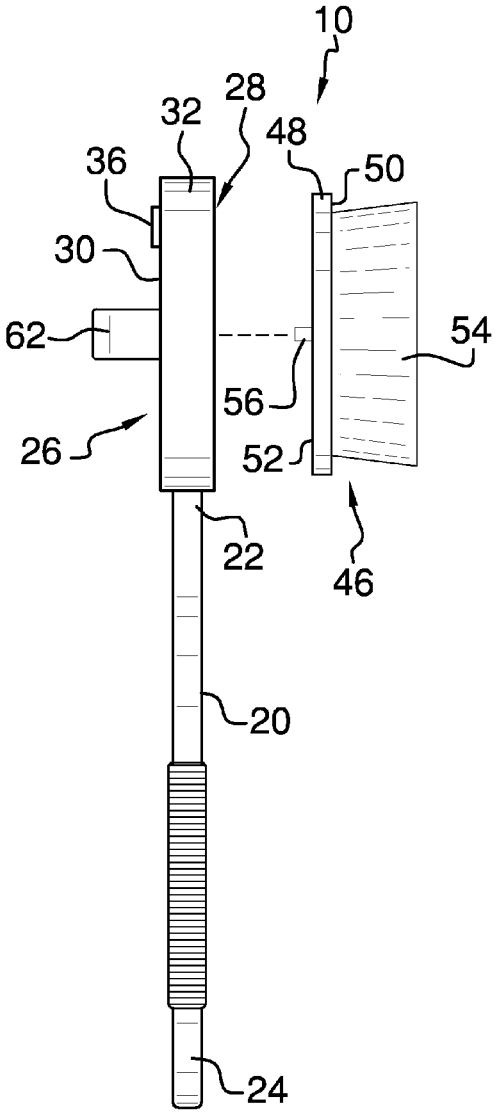
FIG. 5 is a side view.
Figure 6:
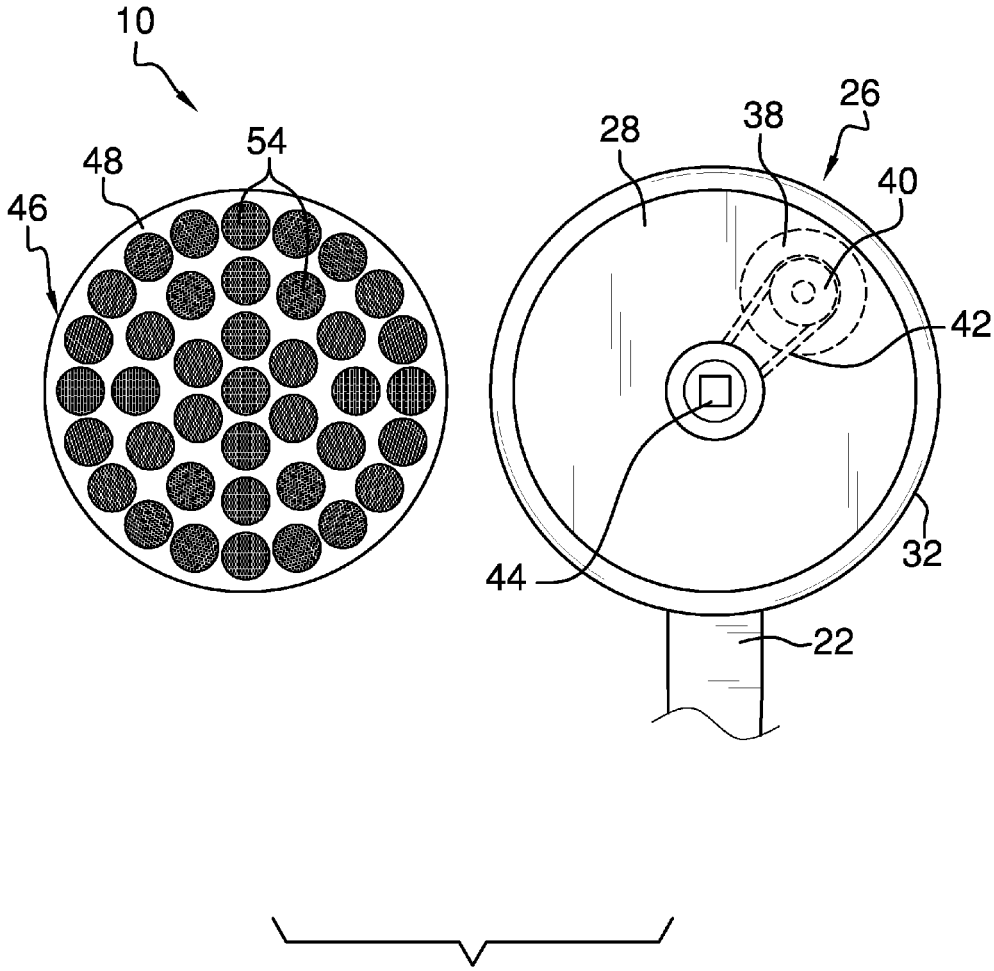
FIG. 6 is a detail view of a head portion with an attachment member detached therefrom.

With reference now to the drawings, and in particular FIGS. 1 through 6 thereof, example of the instant battery operated detachable back scrubber employing the principles and concepts of the present battery operated detachable back scrubber and generally designated by the reference number 10 will be described.

Referring to FIGS. 1 through 6 a preferred embodiment of the present battery operated detachable back scrubber 10 is illustrated.

The present battery operated detachable back scrubber 10 combines a head portion 26 detachable from a handle 20 whereby the head portion 26 is wieldable independent of the handle 20. Moreover, the head portion 26 is interconnectable with a plurality of attachment members 46 whereby rotational movement of a motor 38 is communicable to a plurality of tactile devices 54 disposed on a front surface 50 of a base 48 of each of said attachment members 46. Each of the plurality of attachment members 46 is considered to present a different arrangement of tactile devices 54, and, for example, includes a plurality of bristles and, alternately, a plurality of massage pads.

The battery operated detachable back scrubber 10 includes a handle 20 having a distal end 22 and a proximal end 24. A head portion 26 is releasably attachable to said handle 20 at the distal end 22. The head portion 26 includes a first side 28, a second side 30, and a bordering surface disposed between the first side 28 and the second side 30. In the preferred embodiment herein disclosed the bordering surface is a circumferential surface 32 as the head portion 26 is circular. However the use of the term "bordering surface" should be considered descriptive of a surface disposed around a perimeter perpendicularly between to two parallel surfaces.

A battery compartment 34 is accessible through the second side 30 of the head portion 26. The battery compartment 34 is wired in circuit with a power button 36 disposed on the second side 30 of the head portion 26, said power button 36 depressible to activate and alternately deactivate the device 10, as desired for use. It should be readily understood that the device 10 is water resistant, that the battery compartment 34 is a sealable enclosure.

A motor 38 is wired in circuit with the battery compartment 34 within the head portion 26. The motor 38 includes a gear wheel 40 operationally communicating rotational movement to a drive belt 42, which drive belt 42 in turn rotationally engages a rotatable connect socket 44 centrally disposed in the first side 28 of the head portion 26. The gear wheel 40 and the drive belt 42 are considered to increase the torque upon the rotatable connect socket 44 (see FIG. 6).

The rotatable connect socket 44 is centrally disposed within the first side 28 of the head portion 26. An interchangeable attachment member 46 is configured to releasably connect with the rotatable connect socket 44 disposed in the head portion 26, whereby one of the plurality of attachment members 46 is releasably attachable to the head portion 26. In the preferred embodiment herein disclosed, the first side 28 of the head portion 26 is recessed upon the head portion 26 and the attachment member 46 base 48 sets into the head portion 26 to cover the first side 28 when the attachment member 46 is releasably attached to the head portion 26 (see FIG. 3).

Each attachment member 46 includes a base 48 having a front surface 50 and a rear surface 52. A plurality of tactile devices 54 is disposed on the front surface 50 of the base 48, said tactile devices 54 configured to moveably engage with a body of a user. The plurality of tactile device 54 include a plurality of bristles and a plurality of massage pads, but alternate embodiments are considered with said plurality of bristles and massage pads configured in alternate arrangements accordant with a particular use, such as deep tissue massage, for example, or long bristles for scrubbing, and short bristles for exfoliating.

A drive shaft 56 is centrally disposed upon the rear surface 52 of the base 48. The drive shaft 56 is configured to releasably connect with, and is operationally engaged by, the rotatable connect socket 44. Thusly, rotational movement of the motor 38 is transferred to the drive shaft 56 by means of the rotatable connect socket 44 whereby the plurality of tactile devices 54 is operationally engaged (see FIG. 4).

An interconnect 58 is disposed upon the circumferential surface 32 of the head portion 26, said interconnect 58 configured to releasably interconnect with a pair of spring hooks 60 disposed at the handle 20 distal end 22. In the preferred embodiment herein disclosed, the interconnect 58 is disposed upon the circumferential surface 32 at a most distant position relative the power button 36.

A hand strap 62 is disposed on the head portion 26 second side 30 whereby the head portion 26 is securably wielded by a user absent the handle 20 when the handle 20 has been detached from the head portion 26 by disengagement of the pair of spring hooks 60 from the interconnect 58.

The present battery operated detachable back scrubber 10 is thus usable to assist soaping and scrubbing in the shower, wherein the handle 20 enables application of the tactile devices 54 to the hard-to-reach parts of the dorsal side of a human. And yet the device is usable to massage, as desired, by means of interchanging the attachment member 46, wherein the plurality of tactile devices 54 are massage pads which, operationally engaged by means of the motor 38, enable massaging of the same hard-to-reach parts of the body. Detachment of the handle 20 enables scrubbing or massage, as desired, with the device 10 securely manipulated in a single hand by means of the hand strap 62 releasably engaging with a user's hand.

What is claimed is:

1. A battery operated detachable back scrubber comprising:

a handle;

a head portion releasably attachable to said handle, said head portion comprising:

a first side;

a second side;

a bordering surface disposed between the first side and the second side;

a battery compartment accessible through the second side;

an interconnect disposed upon the bordering surface of the head portion, said interconnect configured to releasably interconnect with the handle; and a rotatable connect socket centrally disposed within the first side;

a hand strap disposed on the second side;

an interconnectable attachment member comprising:

a base having a front surface and a rear surface;

a plurality of tactile devices disposed on the front surface of the base; and a drive shaft centrally disposed upon the rear surface of the base, said drive shaft configured to releasably connect with the rotatable connect socket; and a motor disposed within the head portion, said motor operationally communicating with the rotatable connect socket;

wherein the head portion is detachable from the handle and wieldable in the hand, said head portion securable by means of the hand strap;

wherein the rotatable connect socket rotationally engages the driveshaft whereby the plurality of tactile devices is rotationally engaged;

wherein the attachment member is interchangeable with a plurality of additional attachment members having alternate configurations of tactile devices; and wherein the motor moveably engages the rotatable connect socket by means of a drive belt disposed to transfer a rotational movement of the motor to the rotatable connect socket.

2. The battery operated detachable back scrubber of claim 1 wherein the head portion further comprises a power button disposed on the second side of the head portion, said power button depressible to activate and alternately deactivate the device.

3. The battery operated detachable back scrubber of claim 2 wherein the motor includes a gear wheel, said gear wheel configured to rotationally engage the drive belt whereby a rotational movement of the motor is transferred to the rotatable connect socket.

4. The battery operated detachable back scrubber of claim 3 wherein the handle comprises a proximal end and a distal end.

5. The battery operated detachable back scrubber of claim 4 wherein the handle further comprises a pair of spring hooks disposed at the distal end, each of said pair of spring hooks configured to releasably engage with the interconnect disposed on the head portion.

6. A battery operated detachable back scrubber comprising:

a handle having a distal end and a proximal end;

a circular head portion releasably attachable to said handle, said head portion comprising:

a first side;

a second side;

a circumferential surface disposed between the first side and the second side;

a sealable battery compartment accessible through the second side;

a power button disposed on the second side of the head portion, said power button depressible to activate and alternately deactivate the device;

an interconnect disposed upon the circumferential surface of the head portion, said interconnect configured to releasably interconnect with the handle; and a rotatable connect socket centrally disposed within the first side;

a hand strap disposed on the head portion second side;

a pair of spring hooks disposed at the handle distal end, each of said pair of spring hooks configured to releasably engage with the interconnect disposed on the head portion;

an interchangeable attachment member comprising:

a base having a front surface and a rear surface;

a plurality of tactile devices disposed on the front surface of the base; and a drive shaft centrally disposed upon the rear surface of the base, said drive shaft configured to releasably connect with the rotatable connect socket;

a motor disposed within the head portion, said motor comprising:

a gear wheel; and a drive belt rotationally engaged by rotational movement of the gear wheel, said drive belt operationally communicating rotational movement of the gear wheel to the rotatable connect socket;

wherein the head portion is detachable from the handle and wieldable in the hand, said head portion securable therein by means of the hand strap; and wherein the rotatable connect socket rotationally engages the driveshaft whereby the plurality of tactile devices is rotationally engaged.

7. The battery operated detachable back scrubber of claim 6 wherein the plurality of tactile devices is a plurality of bristles.

8. The battery operated detachable back scrubber of claim 7 wherein the plurality of tactile devices is a plurality of massage pads.

* * * * *